US006878422B1

(12) United States Patent
Spaar

(10) Patent No.: US 6,878,422 B1
(45) Date of Patent: Apr. 12, 2005

(54) THREE-DIMENSIONAL HANGING DECORATION

(75) Inventor: Keith Spaar, River Vale, NJ (US)

(73) Assignee: Amscan, Inc., Elmsford, NY (US)

( * ) Notice: Subject to any disclaimer, the term of this patent is extended or adjusted under 35 U.S.C. 154(b) by 0 days.

(21) Appl. No.: 10/459,009

(22) Filed: Jun. 12, 2003

(51) Int. Cl.[7] ..... A47G 35/00

(52) U.S. Cl. ..... 428/9; 428/7; 428/28; 428/105; 428/542.6; 40/617; D11/131; D11/141

(58) Field of Search ..... 428/7, 15, 9, 66.5, 428/542.2, 542.6, 115, 105, 28; 40/617; D11/141, 131; D21/455, 465, 467; 446/227, 487, 488, 490

(56) References Cited

U.S. PATENT DOCUMENTS

D413,078 S * 8/1999 Hanson ..... D11/141
6,485,801 B1 * 11/2002 Chen ..... 428/28

OTHER PUBLICATIONS

"Baby Spiral Mobiles" Company: CEG Catalog: Creative Expressions Date: Everyday 1999 p.: 310.
"Patriotic Visuals" Company: CEG Catalog: Creative Expressions Date: Spring 2003 p.: 118.
"Swirling Flags" Company/Catalog: Lillian Vernon Date: May or Jun. 2003 p.: 6.

* cited by examiner

*Primary Examiner*—Jennifer McNeil
(74) *Attorney, Agent, or Firm*—Levisohn, Berger & Langsam LLP

(57) ABSTRACT

A three-dimensional, hanging decoration comprised of a connecting portion and at least one spiraling portion. The device transformed from a flat, lightweight sheet of flexible material (for easy shipping, storage and sale) into a three-dimensional, fanciful, eye-catching and air-current movable party decoration. The visual look and feel of the hanging decoration is that of a spent, thrown or unwound serpentine or party streamer. The three-dimensional hanging decoration may be provided with decorative ornaments which hang downwardly from various points along the connecting portion and/or the spiraling portion. When laid on a flat surface (for shipping and storage), the three-dimensional hanging decoration consumes a minimum of space in that it rests substantially flat. When the decoration is hung after purchase by the consumer, the connecting portion and/or the spiraling portion is suspended from, for example, a ceiling or chandelier, and streamed in the air, in such a way that the sheet of flexible material is transformed into a three-dimensional hanging decoration which emulates that of a thrown or unwound serpentine or party streamer. The lightweight and spiral design and the reverse twist provided by the connecting portion provide the desired visual appeal and allow the three-dimensional hanging decoration to easily rotate and move when grazed by minimal air currents without mechanical help, all to increase the decoration's visual appeal. Large surface area is presented in a range of orientation to catch air currents. Preferably, the device is made of strong yet inexpensive Mylar or paper card stock.

3 Claims, 4 Drawing Sheets

THREE-DIMENSIONAL HANGING DECORATION

BACKGROUND OF INVENTION

1. Field of the Invention

The present invention is an inexpensive, pre-assembled party decoration, like a hanging mobile yet providing a serpentine or spiral shape similar to that of a party decoration sometimes called a serpentine or streamer, after unwinding. The serpentine or streamer is generally thrown while one end is held. As it travels in the air, the coil unwinds and provides a visually attractive party decoration. However, it quickly falls to the ground (or over some object). It thus quickly loses its visual appeal and becomes "trash." The present invention, on the other hand, provides the visual look of a "spent" party streamer, i.e., a serpentine or unwound and colorful spiral, yet its visual appeal is suspended in time and space by being attached to the ceiling. The party decoration of the present invention is preferably made from light reflective and sturdy material which is sold, shipped, and stored flat. After purchase by a consumer, the decoration is suspended for example from a ceiling or chandelier and its own weight causes it to suspend downwardly or stream in the air, in such a way that the flat, lightweight sheet of flexible material is transformed into a three-dimensional, eye-catching object, emulating the look and feel or a party streamer or serpentine. It is, however, maintained for the duration of the party in that it is suspended from the ceiling. Thus, a highly desirable party decoration is provided. The lightweight spirals of the present invention provide the visual appeal of the spent or unwound serpentines or streamers and also allow the three-dimensional hanging decoration to easily rotate and move even when barely grazed by minimal air currents, all without mechanical help, so to further increase their visual appeal. The spiral(s) are connected to the main body of the decoration by a connecting portion which provides a downwardly extending reverse twist. It, too, easily catches wind currents and causes the device to easily spin.

2. Description of Related Art

Hanging party decorations are often used to adorn walls and ceilings during festivities or other special occasions. However, some of the conventional hanging decorations are static and/or two-dimensional. This static and/or two-dimensional aspect means that people quickly lose interest in them. There are, of course, three dimensional and air-rotatable party decorations. These, however, are not meant to emulate the look and feel of the spend or unwound serpentines or streamers. The present invention, is lightweight, inexpensive, and easy to store, ship and sell. It provides the visual appeal of a spent or unwound serpentine or streamer, "frozen" in time and space, since it is suspended from the ceiling.

Some of the known hanging decorations which are three-dimensional are difficult to ship and store due to the fact that they take up more shelf space and are more fragile than their two-dimensional counterparts. Also, some of the three dimensional hanging party decorations are so heavy and/or bulky that they barely move when suspended and hung.

Therefore, it is one object of the present invention to provide a three-dimensional hanging decoration with a dynamic visual interest. It is an object of the present invention to provide a hanging decoration which provides its visual image for the duration of a party and provides the visual look of a spent or unwound serpentine or streamer.

Another object of the present invention is to provide a three-dimensional hanging decoration which is easy and efficient to ship and store. It is shipped and stored flat yet quickly assumes a three-dimensional shape. Upon assembly, which is merely the process of the user picking out and suspending the intended high point of the device, the balance of the device hangs downwardly and even minimum air currents are captured by the spirals and/or the reverse twist section of the connecting portion (mechanically connecting spiral to main body) to cause the device to rotate in even minimum air currents. This, of course, results in a far more interesting and visual pleasing device. It results in a party decoration which emulates a spent or unwound serpentine or party streamer; a device which is visually appealing for the duration of the party since it is suspended from the ceiling.

SUMMARY OF THE INVENTION

An object of the present invention is to provide a three-dimensional hanging decoration, comprised of a main section, a connecting portion and at least one downwardly connecting spiraling portion. The three-dimensional hanging decoration retains a two-dimensional shape when laid flat for efficient shipping and storage. When the decoration is hung, the connecting portion provides a reverse twist and the spiraling portion is suspended and streamed in the air from the main body section, in such a way that the sheet of flexible material is transformed into a three-dimensional, hanging party-like decoration which emulates a spent or thrown serpentine or party streamer. However, in contrast to a spent or thrown serpentine or party streamer, the present invention does not fall to the ground and quickly become party trash but, rather, as a consequence of the suspension of the present invention from the ceiling, it is visually present throughout the party. In addition, the design of the present invention makes it an air current "catcher." The lightweight spiral and connecting portion with the reverse twist create a three-dimensional hanging decoration which easily rotates and moves when grazed by even minimal air currents, all without mechanical help, all to its visual appeal.

Other advantages and novel features of the invention will become more apparent from the following detailed description, taken in conjunction with the accompanying drawings.

DETAILED DESCRIPTION OF THE DRAWINGS AND THE PREFERRED EMBODIMENTS

Figure 1:
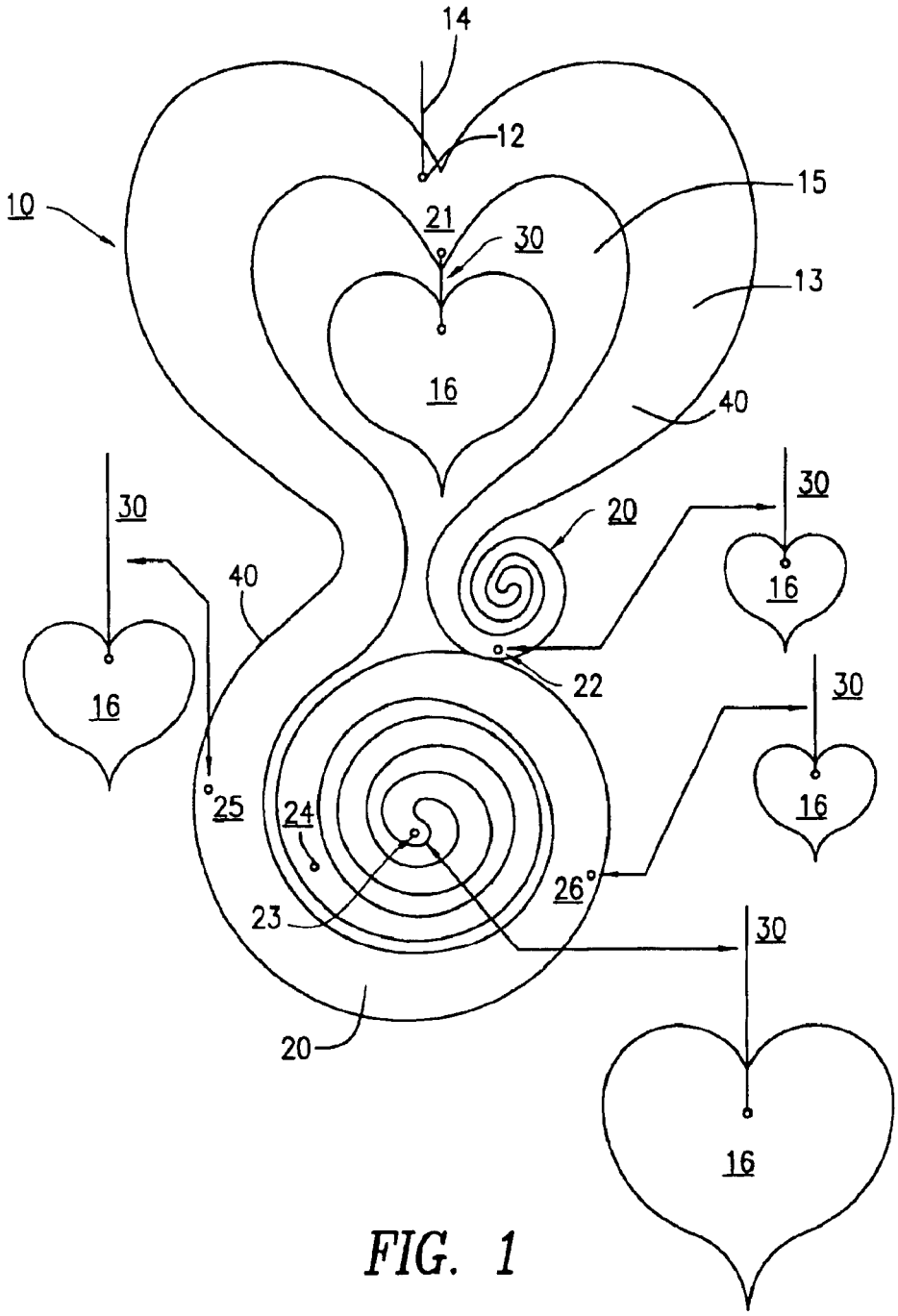
FIG. 1 is a plan view of the three-dimensional hanging decoration in accordance with the present invention, when laid flat for shipping and storage.

With reference to FIG. 1, a three-dimensional hanging party-like decoration is constructed i.e., die-cut from a thin flexible sheet of material. Preferably, the material is colorful Mylar but any sturdy, somewhat resilient, or thin stock paper will suffice. The paper can be one or more colors or having no color (white) or have designs printed thereon. The hanging decoration 10 has a top or apex 12 to which a suspending string 14 is secured. In the preferred embodiment, the string passes through a small hole in the top 12, is knotted on one side to ensure it does not slip through the bole and the free end of the string provided with a hook, tape or another means (not shown) to allow the decoration 10 to be suspended from a ceiling, a chandelier or a wall sconce, etc.

The decoration 10 comprises a main body 13 having some "bulk" and one or more connecting portions 40 attached and downwardly extending therefrom when the decoration is suspended. The visual appeal of the present invention is to provide a frozen in time "look and feel" of a spent or thrown party decoration, i.e., a serpentine or party streamer. During shipping and storage, the three-dimensional hanging decoration rests flat in a two-dimensional plane. This allows for easy shipping and storage as the three-dimensional hanging decoration consumes minimal space when laid flat. Preferably, the device is sold in an envelope with the three-dimensional device photographed on the outside of the envelope to facilitate the efficient display by a merchant and the consumer's selection of the design without opening up of the package for inspection prior to purchase. Furthermore, during shipping and storage, individual three-dimensional hanging decorations (in their two-dimensional storage condition) may be neatly stacked on top of one another without the need to take additional precautions to avoid damage to the products.

In a preferred embodiment, the entire three-dimensional hanging decoration is constructed from a flat, lightweight, light-reflective, flexible sheet of material, preferably colored mylar. The main body 10 is decorative, and in the present example, is formed with its outside edge in the shape of a large heart (for Valentine's Day, for example) 13 forming a window cutout 15 for a smaller solid heart 16. Of course, these can be die-cut from the same original flat sheet. This is cost effective for a manufacturer. Furthermore, the three-dimensional hanging decoration is provided with one or more additional decorative ornaments, like hearts 16 hanging by string or thread from various other points of the device. The decorative ornaments (preferably hearts 16 for the Valentine motif of the disclosed embodiment) may be formed in any shape relating to a festive occasion or holiday. These, too, are cut from the same original sheet of material or, of course, can be cut from a color-contrasting different sheet. In the present example, the decorative ornaments 16 are formed in the shape of hearts and compliment the shape of the main body 10 and window cutout 15. The decorative ornaments (heart 16) are preferably attached by strings 30 at selected points of the main body portion 10 as well as to points 22 of suspended spiraling portion 20, and points 23, 24, 25 and 26 of the bottom and larger spiraling portion 20.

Furthermore, in a preferred embodiment, the three-dimensional hanging decoration has one or more suspended spiraling portions 20 connected to the main body 10 by connecting portions 40. The multiple spiraling portions 20 extend from either side of the main body portion 10 and spiral or curl, from outside to inside. The use of the spiral(s) suspended from above, through a reverse twist of a connecting portion creates the visual image of a spent or thrown serpentine or party streamer. The lightweight and spiral designs of spiraling portion 20 of the suspended three-dimensional hanging decoration allows the decoration to easily rotate even when grazed by minimal air currents (i.e., without mechanical help) all to increase the overall visual appeal.

The connecting portions 40, connected between each spiral portions 20 and the main body 10, when elongated or pulled by the weight of a spiral portion, exhibit a reverse twist, similar to a downwardly extending yet warped from side to side, playground slide. This reverse twist of the connecting portions 40, accompanied by one or more spiral windings, in the same or opposed spiral directions, presents a large and varied surface area in three dimensions. This adds to the visual effect of emulating a spent or thrown serpentine or party streamer. Even small air drafts will cause the decoration to spin about the axis of string 14. This is, of course, visually attractive and an effective party decoration.

Figure 2:
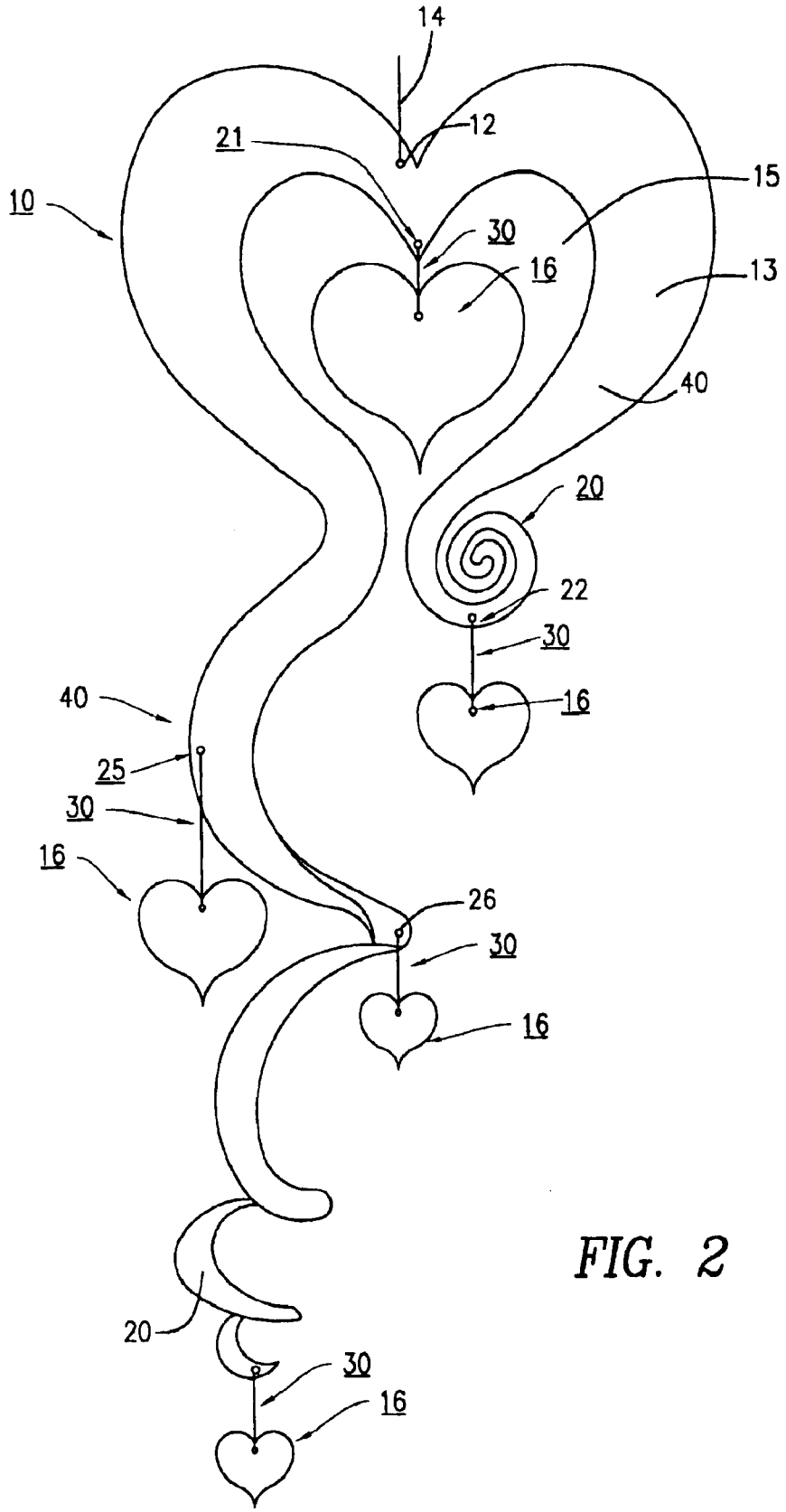
FIG. 2 is a perspective view of the hanging decoration of FIG. 1 when suspended from above, thereby exhibiting its three-dimensions.

As shown in FIG. 2, when the main body portion 10 and spiraling portions 20 are suspended by the connecting portions 40, all streamed in the air, the light reflective, lightweight sheet of flat, flexible material is transformed into a three-dimensional, visually attractive hanging party decoration. The party decoration of the present invention is intended to emulate that of a spent or thrown serpentine or party streamer, yet "frozen in time" since suspended from above. The reverse twist of the connecting portions 40 of the decoration facilitates and adds to this visual effect. The multiple spiraling portions 20 and connecting portions 40 extend from either and/or both side(s) of the main body portion 10 and spiral or curl in the same or opposed directions. The lightweight sheet of flexible material and opposing spiraling portions 20 and connecting portions 40 extend from either or both sides of the main body portion 10 and cause the three-dimensional hanging decoration to rotate when grazed by minimal air currents originating from a variety of directions. The decorations can be suspended via a hanging string 14. Furthermore, the hanging decoration is suspended and downwardly streamed in the air by the sole weight and elasticity of the sheet of material from which it is cut. This contributes to the dynamic aspect as well as the three-dimensional quality and the visual appeal of the three-dimensional hanging decoration.

In the embodiment of FIGS. 1 and 2, for example, the upper or small spiral 20 curls counterclockwise from outside to inside, when the device is flat. The larger and lower spiral 20 curls in the same direction, i.e., when flat, it, too, curls in a counterclockwise direction from outside to inside. When the decorative device is suspended, the small spiral 20, when viewed from above, slopes downwardly, outside to inside, in a counterclockwise curl while the larger spiral 20, when viewed from the top, outside to inside also curls downwardly in a counterclockwise direction. The connecting portions 40 extend between the main body and each spiral. The overall visual effect is that of a suspended in time and space, spent or thrown party serpentine or party streamer.

Figure 3:
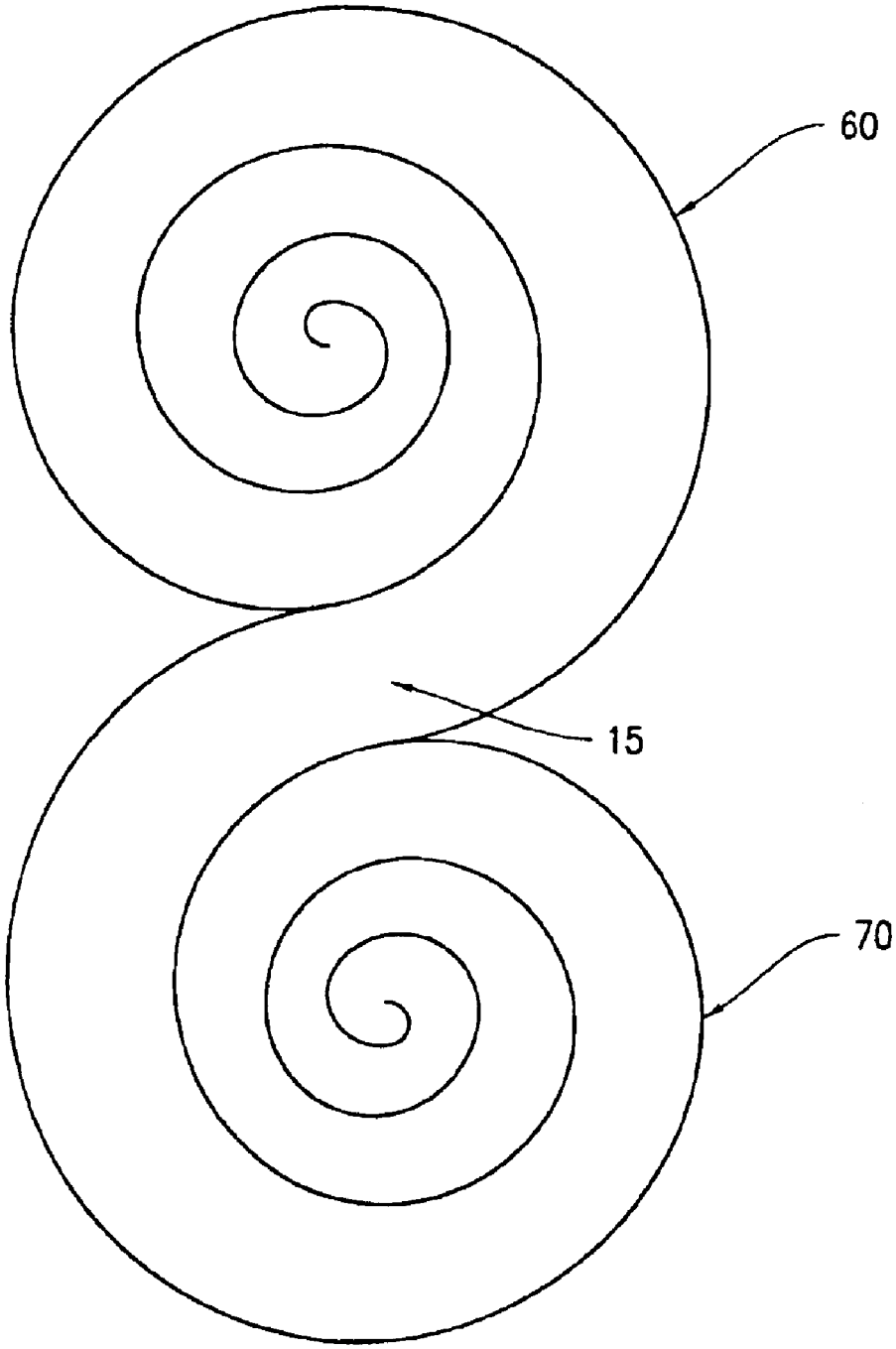
FIG. 3 is a plan view of a second embodiment of the inventive hanging party-like decoration shown in FIG. 3, when laid flat for shipping and storage.

In a second embodiment, as shown in FIG. 3, the three-dimensional hanging decoration is comprised of two same directional-curl spiraling portions 60 and 70 and a single connecting portion 15. As seen in FIG. 3, when laid on a flat surface, spiraling portion 60 winds in a counterclockwise direction (from outside to inside) and spiraling portion 70 also winds in a counter clockwise direction from outside to inside. The two spiral portions 60 and 70 are connected together by S-curve or connecting portion 15.

Figure 4:
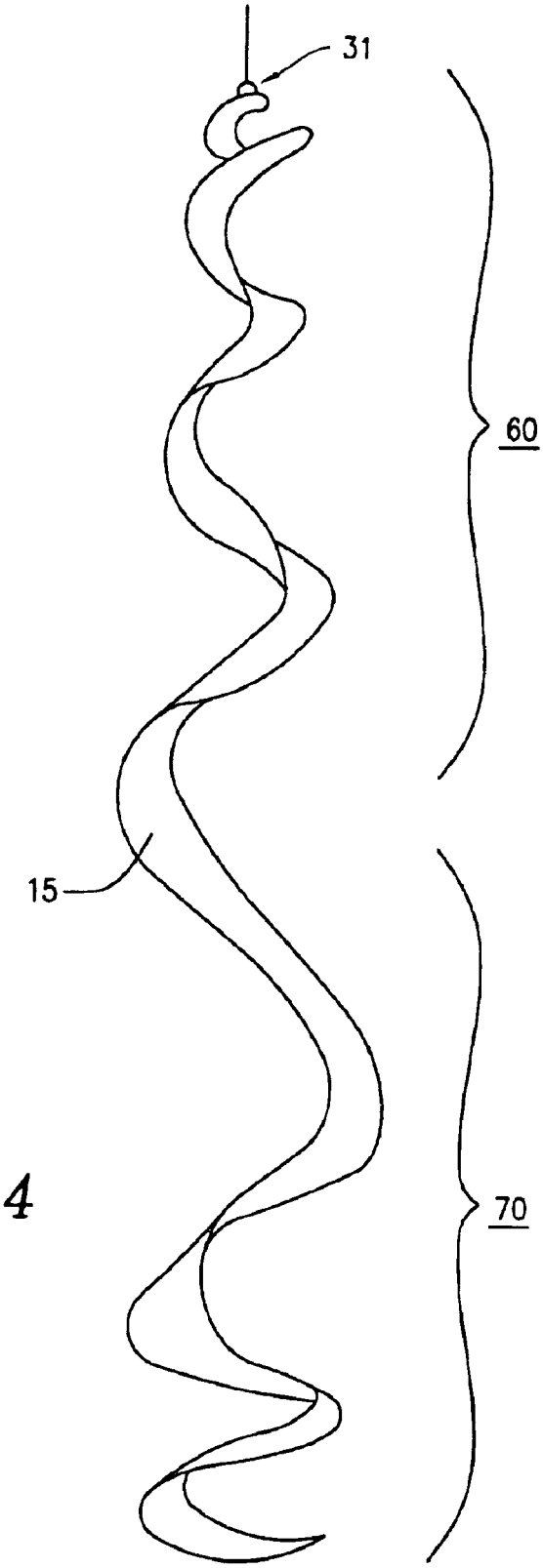
FIG. 4 is a perspective view of the second embodiment of the hanging decoration, being shown in three-dimension, when suspended from above.

As seen in FIG. 4, when suspended from its apex 31 and streamed in the air by hanging end 31, spiraling portions 60 and 70 unwind or uncurl to form a three-dimensional hanging decoration which spirals downwardly in a clockwise curl for upper spiral 60 (when viewed from above), and a clockwise direction when viewed from above for spiral 70. The lightweight spirals of the three-dimensional hanging decoration, along with the wind-catching connecting portions, cause the device to rotate when grazed by minimal air currents (without mechanical help) irrespective of the direction from which the air currents originate. The connecting portion 15 has an "S" shape or a reversing downward twist as a consequence of the direction of curl of spirals 60 and 70 and this reverse twist presents additional surface area for wind catching. The visual effect is, however, again, intended to emulate that of a spent or thrown serpentine or party streamer, suspended from above. Large surface area is presented in a range of orientation to catch air currents.

The hanging decoration of the invention has, inter alia, the following advantages:

1. The hanging decoration with three-dimensional contour is preferably made from a single piece of sheet material so that manufacturing costs are low;
2. The ornamental effect of one or more spiraling portions and/or the reverse twist of the connecting portion of the hanging decoration is dynamic, and rotates without mechanical help, when grazed by even minimal air currents;
3. The visual effect is that of a frozen in time and space spent or unwound serpentine or thrown party streamer; and
4. The three-dimensional contour is easily transformed back into a two-dimensional product which allows for minimal storage space during shipping, storage and/or retail display of the product.

It is to be understood, however that even though numerous characteristics and advantages of the present invention have been set forth in the foregoing description, together with details of the structure and function of the invention, the disclosure is merely illustrative, and changes may be made in detail, especially in matters of shape, size, and arrangement of parts within the invention to the full extent indicated by the broad general meaning of the terms in which the appended claims are expressed.

What is claimed is:

1. A hanging decoration comprising:

a main body portion and at least one downwardly suspended spiral portion, said main body and spiral portions formed from thin sheet material and being substantially two-dimensional when laid on a flat surface, said decoration being transformable into a three-dimensional hanging decoration when suspended in the air from a top of the main body or spiral portion; and a connecting portion between said main body and said at least one spiral portion;

wherein said connecting portion exhibits a reverse twist as it slopes downwardly.

2. The hanging decoration as claimed in claim 1, wherein at least one additional spiral portion is provided having a curl direction in the same direction as the curl direction of said first spiral portion when said decoration is laid on a flat surface.

3. The hanging decoration as claimed in claim 1, wherein said hanging decoration is made from light reflective material.

* * * * *